US006390346B1

(12) United States Patent
Thomas

(10) Patent No.: US 6,390,346 B1
(45) Date of Patent: May 21, 2002

(54) SHOULDER CARRYING CASE WITH ADJUSTABLE POCKET FOR A CELLULAR TELEPHONE AND THE LIKE

(76) Inventor: Gerrell T. Thomas, 7584 Merriman Rd., No. 202, Westland, MI (US) 48185

( * ) Notice: Subject to any disclaimer, the term of this patent is extended or adjusted under 35 U.S.C. 154(b) by 43 days.

(21) Appl. No.: 09/585,461

(22) Filed: Jun. 1, 2000

Related U.S. Application Data

(60) Provisional application No. 60/137,357, filed on Jun. 3, 1999.

(51) Int. Cl.[7] ..... A45F 3/02

(52) U.S. Cl. ..... 224/605; 224/626; 224/668; 224/673; 224/236; 224/250; 224/901.4; 224/930

(58) Field of Search ..... 224/603, 605, 224/625, 626, 663, 666, 668, 669, 673, 236, 250, 901.4, 901.6, 914, 930

(56) References Cited

U.S. PATENT DOCUMENTS

| | | | | | |
|---|---|---|---|---|---|
| 2,089,402 | A | * | 8/1937 | Murray | 224/581 X |
| 5,174,483 | A | * | 12/1992 | Moore, IV et al. | 224/250 |
| 5,358,159 | A | * | 10/1994 | Lundie, Jr. | 224/206 |
| D370,776 | S | * | 6/1996 | Frey | D3/218 |
| 5,533,655 | A | * | 7/1996 | Duque | 224/602 |
| 5,653,336 | A | * | 8/1997 | Buonaiuto et al. | 206/320 |
| 5,653,367 | A | * | 8/1997 | Abramson | 224/581 |
| 6,056,174 | A | * | 5/2000 | Minckler | 224/250 |
| 6,182,878 | B1 | * | 2/2001 | Racca | 224/605 |

* cited by examiner

*Primary Examiner*—Stephen K. Cronin
(74) *Attorney, Agent, or Firm*—MacMillan, Sobanski & Todd, LLC

(57) ABSTRACT

An apparatus for carrying a cellular telephone or the like includes an adjustable shoulder harness. The shoulder harness can be adjusted to accommodate different-sized wearers. The apparatus also includes an adjustable pocket for receiving a cellular telephone. The adjustable pocket is attached to the shoulder harness and can be adjusted to accommodate different-sized cellular telephones or the like.

19 Claims, 6 Drawing Sheets

SHOULDER CARRYING CASE WITH ADJUSTABLE POCKET FOR A CELLULAR TELEPHONE AND THE LIKE

This application claim benefit to provisional application 60/137,357 Jun. 3, 1999.

BACKGROUND OF THE INVENTION

This invention relates in general to an apparatus for carrying a cellular telephone or similar item. More specifically, this invention relates to an adjustable carrying case that can be worn over the shoulder of a wearer.

The popularity of cellular telephones continues. With increased popularity, the number of available designs has also expanded. Many designs have resulted in telephones of different dimensions. The length, width, and thickness of one cellular telephone may be substantially different from another cellular telephone.

The compact size of cellular telephones in general is one contributing factor to their popularity. However, the compact size also contributes to a common problem of misplacing or loosing a cellular telephone.

SUMMARY OF THE INVENTION

It is desirable to transport a cellular telephone in a wearable carrying case. Furthermore, it is desirable to provide a carrying case that can accommodate many different-sized cellular telephones.

This invention includes an adjustable carrying case for a cellular telephone or the like. The carrying case includes an adjustable shoulder harness to accommodate different sized wearers and an adjustable pocket to accommodate different-sized cellular telephones.

In a preferred embodiment, an apparatus for carrying a cellular telephone or the like includes an adjustable shoulder harness. The shoulder harness can be adjusted to accommodate different-sized wearers. The apparatus also includes an adjustable pocket for receiving a cellular telephone. The adjustable pocket is attached to the shoulder harness and can be adjusted to accommodate different-sized cellular telephones or the like.

Various objects and advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
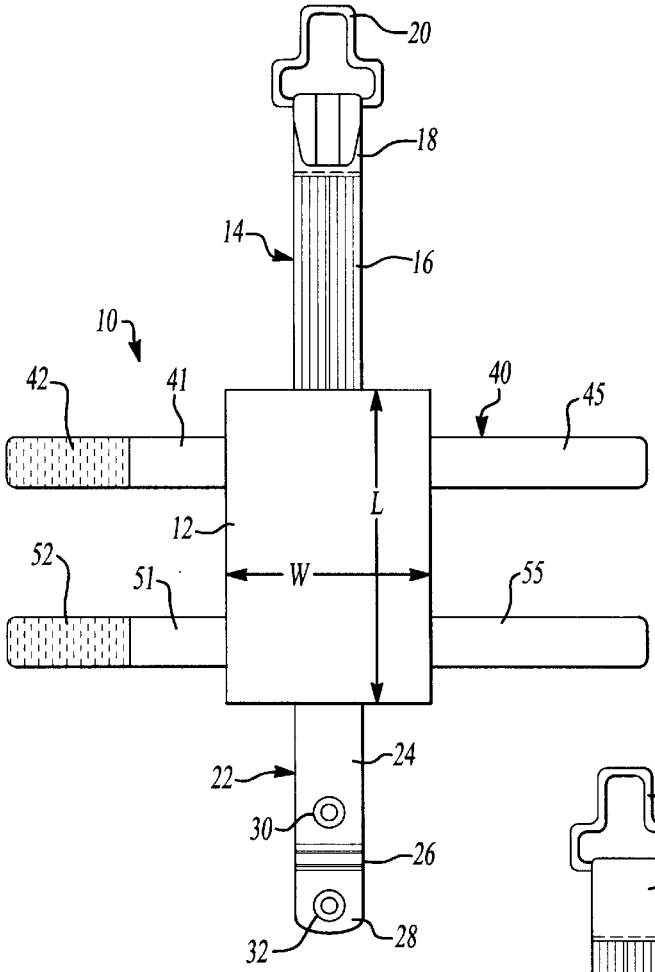
FIG. 1 is a front view of an adjustable pocket for a cellular telephone and the like according to this invention wherein bands and straps are shown in extended positions.
Figure 2:
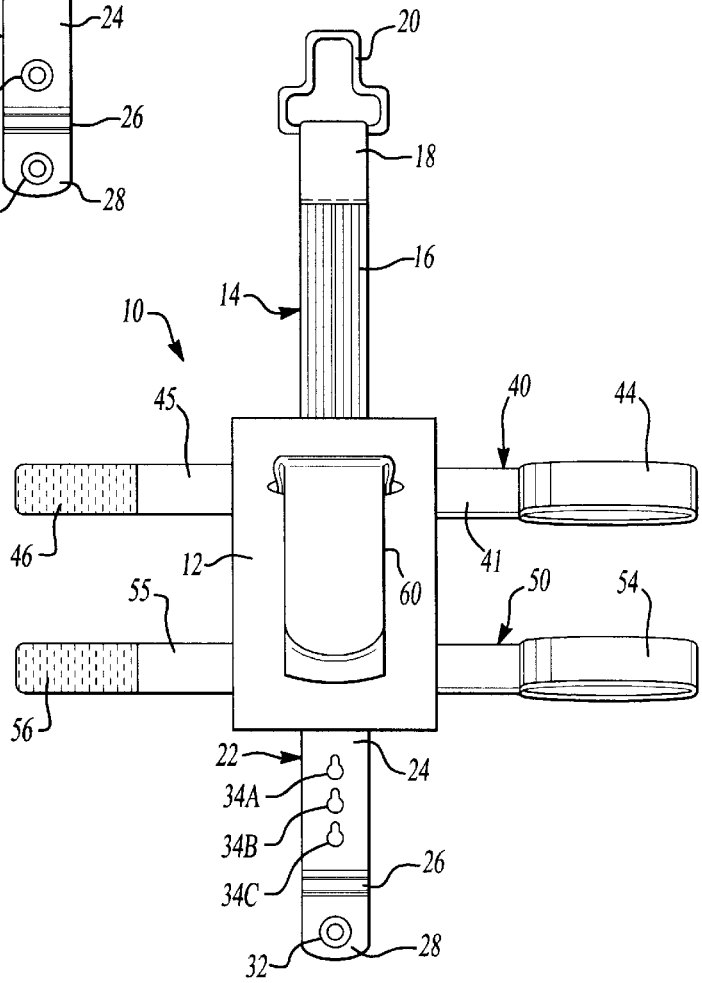
FIG. 2 is a rear view of the adjustable pocket illustrated in FIG. 1.
Figure 3:
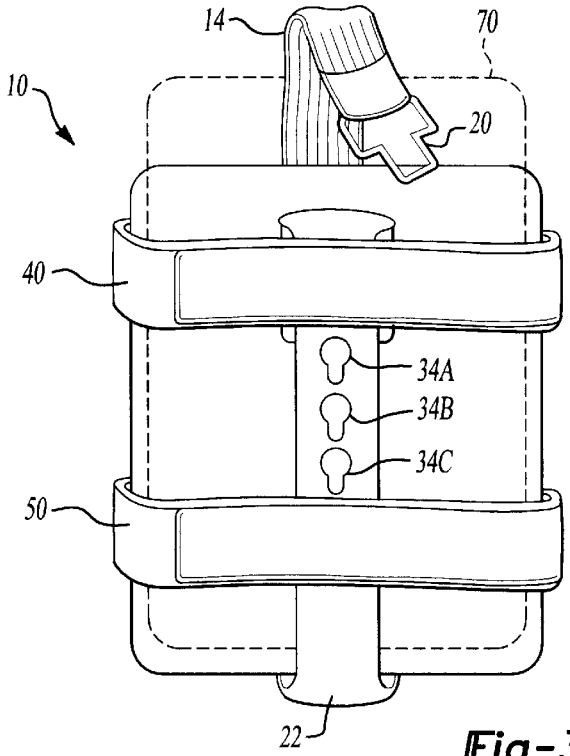
FIG. 3 is a front view of the adjustable pocket illustrated in FIGS. 1 and 2 wherein the straps and bands have been folded.

An adjustable pocket for a cellular telephone and the like is indicated generally at 10 in FIGS. 1, 2 and 3. The pocket 10 can be formed from a variety of materials, including leather, vinyl, and cloth. The pocket 10 is specifically sized to carry a cellular telephone. In addition, the pocket 10 can carry other similar sized items, such as a pager, a calculator, etc.

The pocket 10 includes a central backing piece 12. The backing piece 12 is preferably formed from a rigid material and can be covered with any desired material, including leather, cloth, etc. Preferably, the backing piece 12 is formed as a substantially rectangular member having a length L and a width W selected to accommodate a cellular telephone.

An upper band 14 extends from and is attached to the backing piece 12. The upper band 14 can be attached by any desired means, including stitching. Preferably, the upper band 14 includes a first, stretchable portion 16 and a tab 18. The tab 18 is preferably formed from a durable material such as leather and is attached to a terminal end of the upper band 14. The tab 18 is folded over onto itself to retain a hook 20.

A lower band 22 extends from and is attached to the backing piece 12. The lower band 22 can be attached by any desired means, including stitching. Preferably, the lower band 22 includes a first portion 24 formed from a material such as leather, a second portion 26 formed from a stretchable material, and a third portion 28 formed from a material such as leather. The lower band 22 is aligned with and mates with the upper band 14 as described below.

A male button 30 is provided on a front surface of the first portion 24 and a female button 32 is provided on a front surface of the third portion 28. On its rear surface (see FIG. 2), the lower band includes a plurality of spaced-apart tabs 34A, 34B, and 34C. As described below, the hook 20 is selectively placed on a tab 34A, 34B, or 34C to provide an adjustable band.

A first strap 40 extends from the backing piece 12. The strap 40, preferably formed from a material like leather, includes a first arm 41 extending to the left as viewed in FIG. 1. The first arm 41 includes an area 42 of hook or loop fasteners provided on a front surface of the first arm 41. This area 42 can be formed from a popular material known as VELCRO. As shown in FIG. 2, the first arm 41, now extending to the right, includes a loop 44. A second arm 45, extending to the left in FIG. 2 (and to the right in FIG. 1) includes a complementary area 46 of hook or loop fasteners provided on a rear surface that cooperate with area 42 as described below.

A second strap 50 extends from the backing piece 12 parallel to the first strap 40. The strap 50, preferably formed from a material like leather, includes a first arm 51 extending to the left as viewed in FIG. 1. The first arm 51 includes an area 52 of hook or loop fasteners provided on a front surface of the first arm 51. This area 52 can be formed from a popular material known as VELCRO. As shown in FIG. 2, the first arm 51, now extending to the right, includes a loop 54. A second arm 55, extending to the left in FIG. 2 (and to the right in FIG. 1) includes a complementary area 56 of hook or loop fasteners provided on a rear surface that cooperate with area 52 as described below.

A hook 60 formed from a durable material is provided on the rear surface of the backing piece 12.

As illustrated in FIG. 3, the first arm 41 and the second arm 45 of the first strap 40 are folded upwardly and toward one another over the backing piece 12. The area of hooks 42 are mated with the area of loops 46 to join the arms 41 and 45. In a similar manner, the first arm 51 and the second arm 55 of the second strap 50 are folded upwardly and toward one another over the backing piece 12. The area of hooks 52 are mated with the area of loops 56 to join the arms 51 and 55. The lower band 22 is folded upwardly and inserted through the loops 44 and 54 of the first and second straps 40 and 50. The female button 32 receives the male button 30 as the third portion 28 of the lower band 22 is folded over loop 44. At this point, a cellular telephone 70 indicated in phantom lines in FIG. 3, can be inserted between the backing piece 12 and the straps 40 and 50 and lower band 22. The upper band 14 is then stretched over an upper surface of the telephone 70 until the hook 20 is received on a suitable tab 34A–34C to retain the telephone 70 in the adjustable pocket 10. The adjustablflity of the pocket 10 is easily appreciated by making adjustments with the areas 42, 46, 52, 56 of hook and loop fasteners, the multiple tabs 34A–34C on the lower band 22, and the stretchable portion 16 of the upper band 14.

Figure 4:
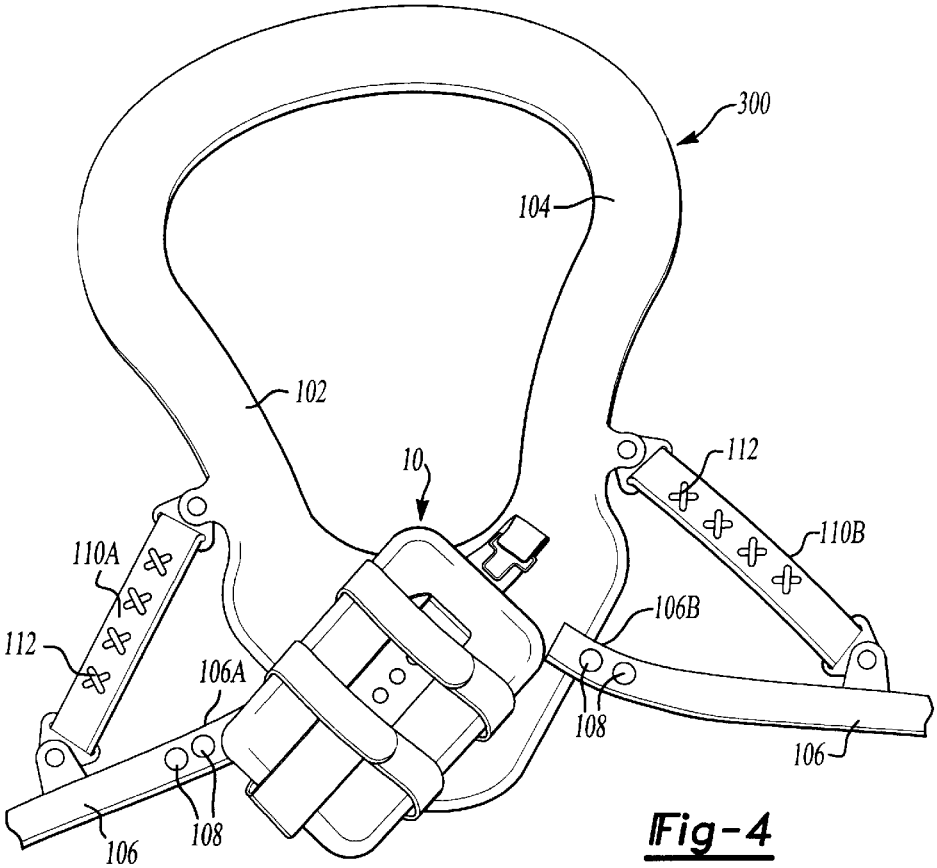
FIG. 4 is a view of an cellular telephone carrying case according to this invention having an adjustable shoulder harness mounting the adjustable pocket illustrated in FIGS. 1–3.
Figure 5:
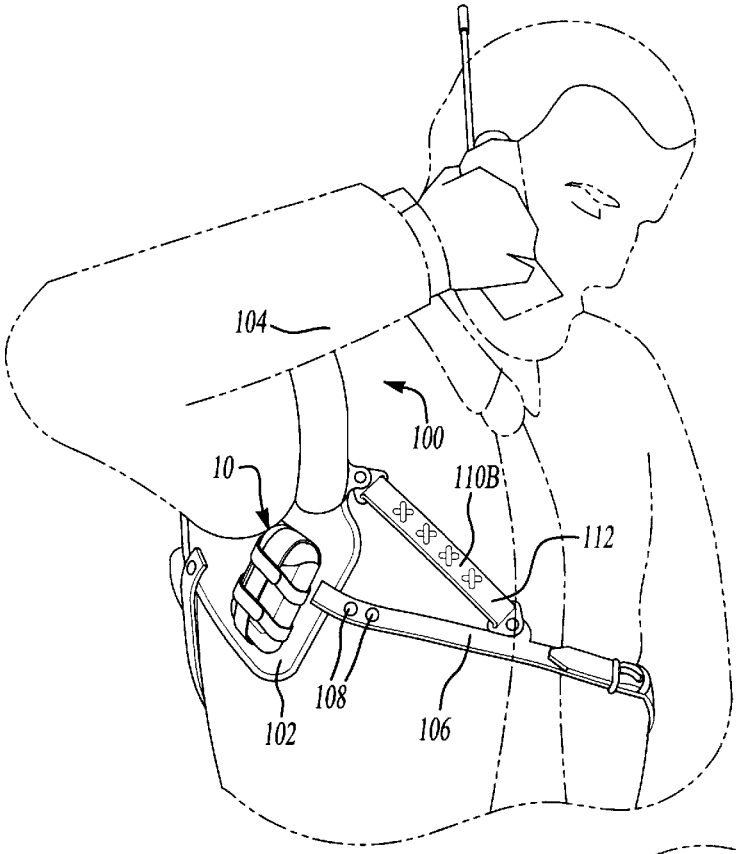
FIG. 5 is a front view of a person wearing the carrying case of FIG. 4.
Figure 6:
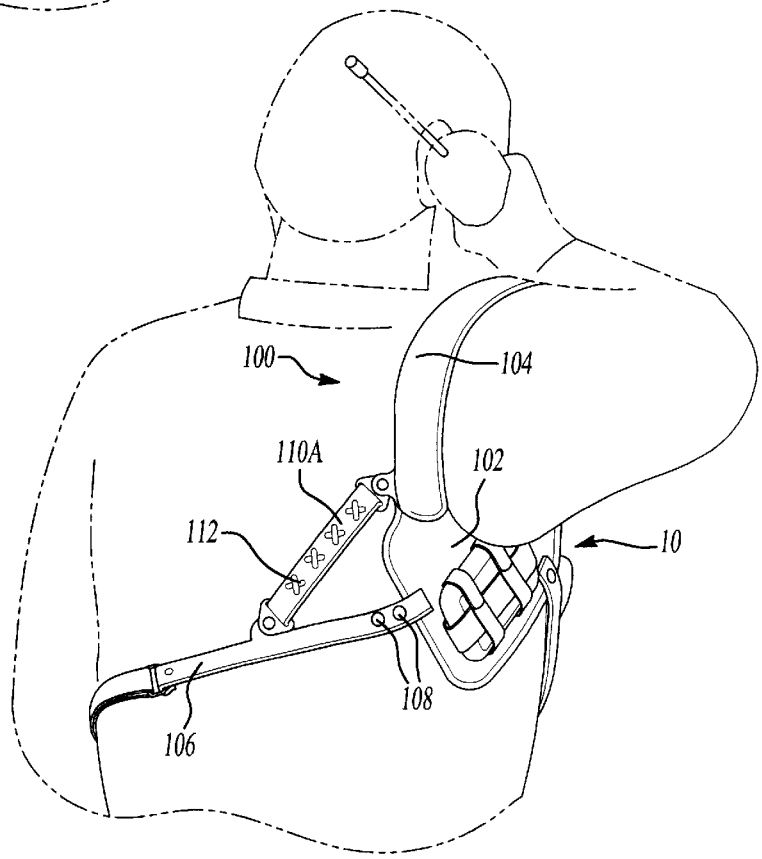
FIG. 6 is a rear view of a person wearing the carrying case of FIG. 4.

The adjustable pocket 10 can be mounted on an adjustable shoulder harness indicated generally at 100 in FIGS. 4, 5, and 6. The hook 60 of the pocket 10 is received in a slot or the like (not illustrated) formed on a central section 102 of the shoulder harness 100. A harness strap 104, designed to fit over a wearer's shoulder, is attached to the central section 102 by any suitable means. A belt 106 is attached to the central section 102 and can be buckled about a wearer. Each end 106A and 106B of the belt can be attached to the central section by any suitable means, including buttons 108. Connecting straps 110A and 110B can be attached between the harness strap and the belt. Indicia and/or decorative markings 112 can be provided on the straps 110A and 110B if desired. The shoulder harness 100 can be adjusted with the belt 106 and buttons 108 to accommodate different-sized wearers. The position of the pocket 10 can be adjusted on the central section to accommodate either a right-handed wearer or a left-handed wearer.

Figure 7:
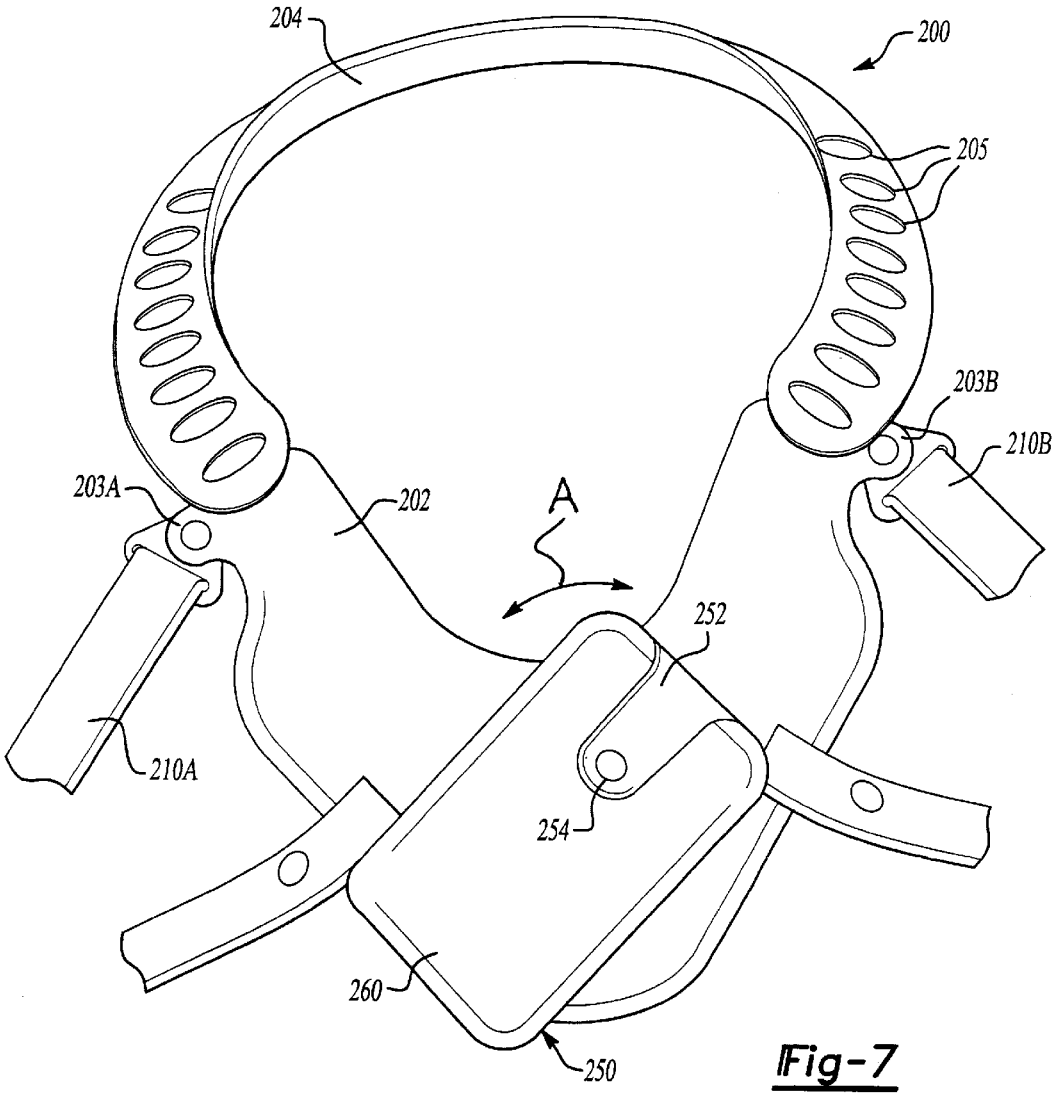
FIG. 7 is a front view of a second embodiment of a cellular telephone carrying case according to this invention having an adjustable shoulder harness mounting a second embodiment of an adjustable pocket.

A second embodiment of an adjustable shoulder harness is indicated generally at 200 in FIG. 7. A central section 202 includes wings 203A and 203B to which connecting straps 210A and 210B can be attached. Vents 205 can be formed in a harness strap 204 for the comfort of the wearer. A second embodiment of an adjustable pocket 250 can be substituted for pocket 10. Pocket 250 includes an upper tab 252 having a snap fastener 254 that is received on mating member provided on an outer surface of a pouch 260. The pocket 250 can be rotated as indicated by arrows A to accommodate either a right-handed wearer or a left-handed wearer.

Figure 8:
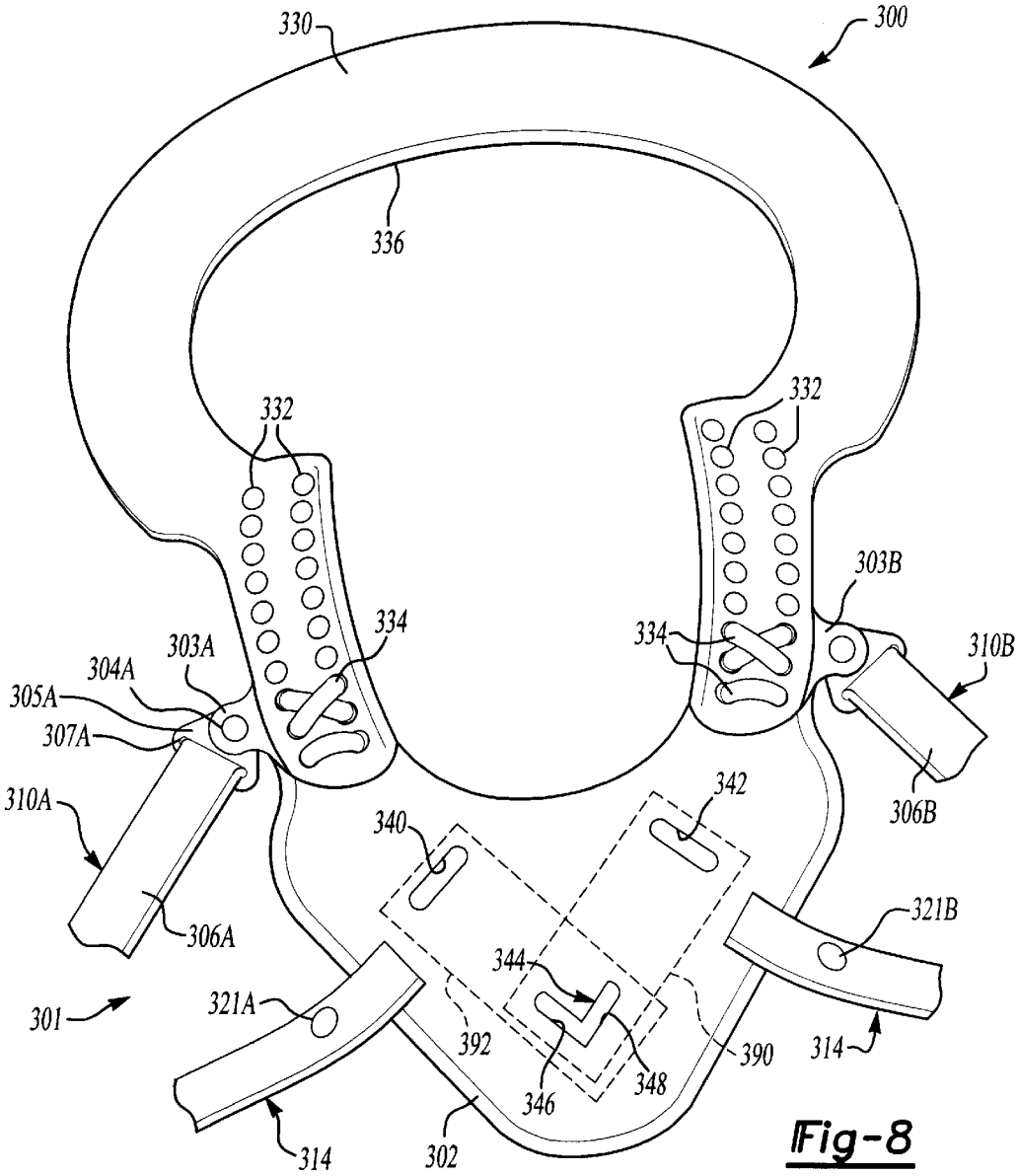
FIG. 8 is a front view of a third embodiment of a cellular telephone carrying case according to this invention having an adjustable shoulder harness mounting an adjustable pocket, wherein the adjustable pocket is illustrated in two alternate positions by dashed lines.
Figure 10:
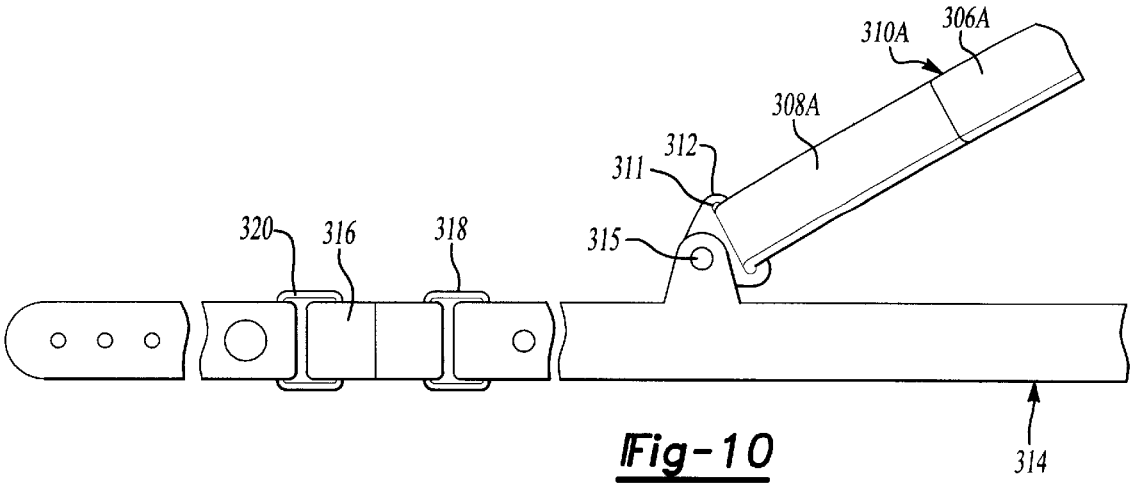
FIG. 10 is a front view of a portion of a left support strap and a left portion of a belt.

A third embodiment of an adjustable carrying case according to this invention is indicated generally at 300 in FIG. 8. The carrying case 300 includes an adjustable shoulder harness indicated generally at 301. A central section or support piece 302 includes wings 303A and 303B to which connecting straps 310A and 310B are attached. A fastener 304A such as a rivet connects wing 303A to a tab 305A. The connecting strap 310A, preferably formed from an elastic material, includes a first loop 306A received through a slot 307A of the tab 305A. As illustrated in FIG. 10, the connecting strap 310A preferably terminates in a second loop 308A received through a slot 311 of a second tab 312. Preferably, the second tab 312 is pivotally connected to a belt 314 by a fastener such as a rivet 315. Preferably, an elastic portion 316 is provided in the belt 314 to provide additional adjustment for a wearer. Rings 318 and 320 can be received through respective loops in the elastic portion 316 and through respective loops in the belt 314 to attach the elastic portion 316 to the belt 314. The belt 314 can be attached to the mounting piece 302 by loops formed by fasteners such as rivets 321A and 321B.

Figure 9:
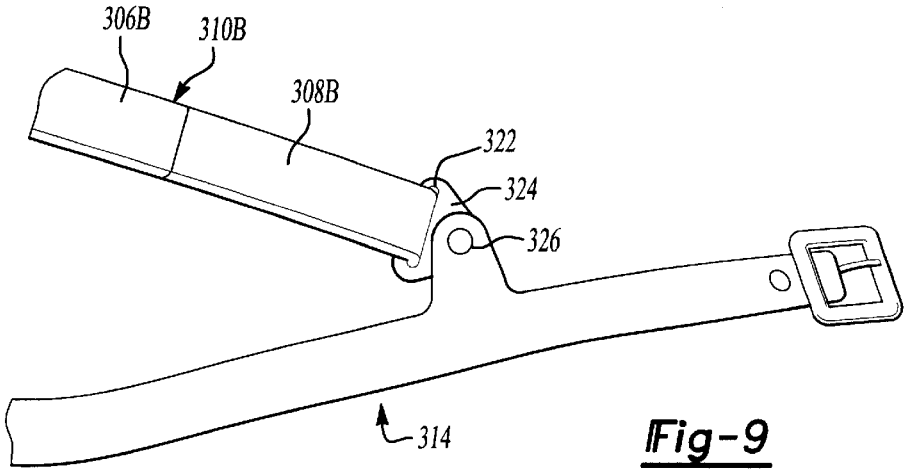
FIG. 9 is a front view of a portion of a right support strap and a right portion of a belt.

As illustrated in FIG. 9, the connecting strap 310B preferably terminates in a second loop 308B received through a slot 322 of a third tab 324. Preferably, the third tab 324 is pivotally connected to the belt 314 by a fastener such as a rivet 326.

A harness strap 330 is attached to the mounting piece 302. A plurality of aligned holes 332 can be provided in the ends of the harness strap 330. Similar holes (not illustrated) can be provided in the wings 303A and 303B. A wire, thread, or any other suitable material 334 can be threaded through the holes 332 to attached the harness strap 330 to the mounting piece 302. Preferably, a cut-out 336 is provided along an inner circumference of the harness strap 330 to enhance the fit and comfort of the shoulder harness 301.

The mounting piece 302 includes a plurality of openings. A first rectangular opening 340 is formed near wing 303A. A second rectangular opening 342 is formed near wing 303B. An L-shaped opening 344 is formed so that each leg 346 and 348 of the L-shaped opening 344 is approximately perpendicular to one of the rectangular openings 340 and 342.

Figure 11:
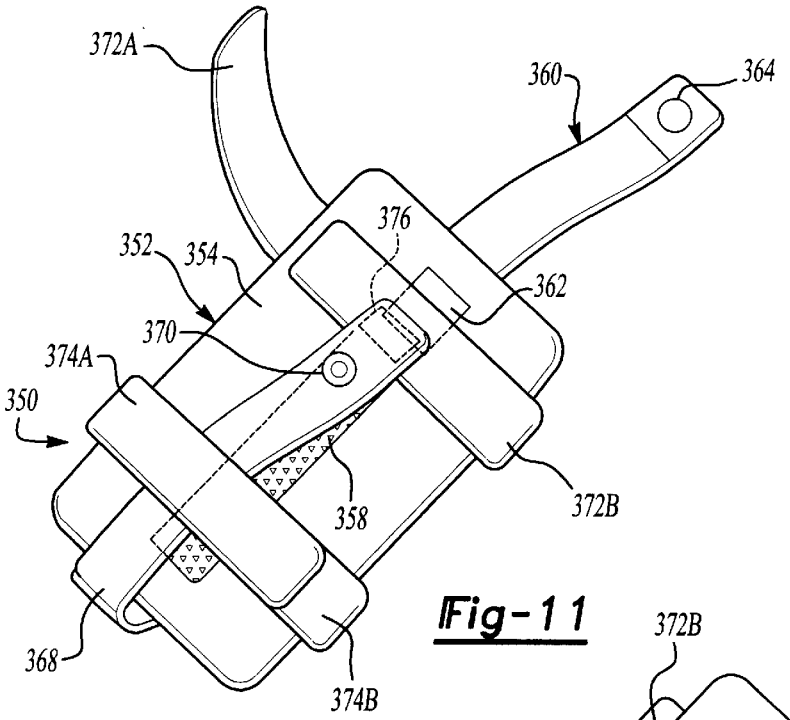
FIG. 11 is a front view of a third embodiment of an adjustable pocket according to this invention removed from the carrying case of FIG 8.
Figure 12:
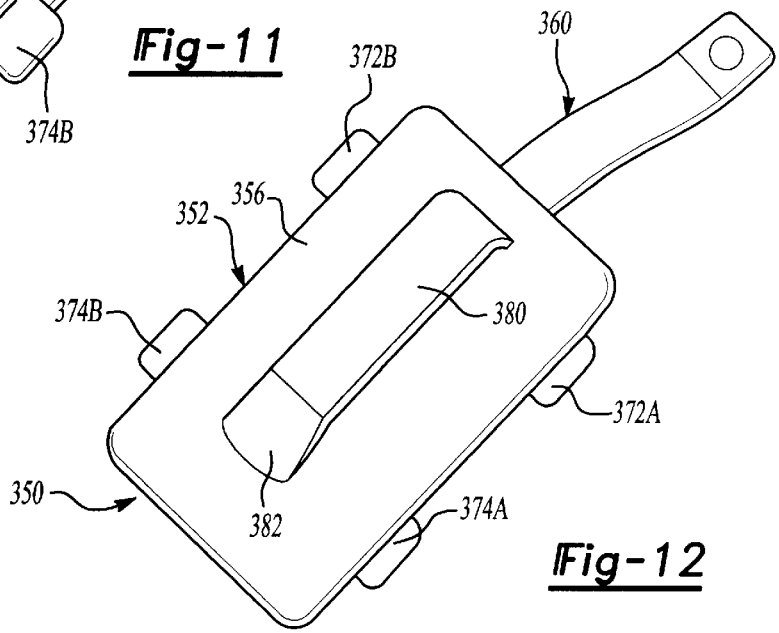
FIG. 12 is a rear view of the adjustable pocket of FIG. 11.

A third embodiment of an adjustable pocket 350 according to this invention is illustrated in FIGS. 11 and 12. The pocket 350 can be mounted on shoulder harness 301 to form an adjustable carrying case 300 for a cellular telephone. The pocket 350 includes a backing piece 352 having a front surface 354 and a rear surface 356. A strip 358 having hook and loop fasteners is mounted on the front surface 354. An upper band 360, preferably formed from an elastic material, includes a section of mating hook and loop fasteners 362 at one end that are attached to the strip 358. A female fastener 364 is provided at an opposite end of the upper band 360. A lower band 368 is attached to the backing piece 352 and wrapped over the front surface 354. A male fastener 370 is provided at a terminal end of the lower band 368.

A first pair of adjustable arms 372A and 372B is attached to the backing piece 352 and wrapped over the front surface 354. Preferably, the arms 372A and 372B include hook and loop fasteners on facing surfaces. A second pair of adjustable arms 374A and 374B is attached to the backing piece 352 and wrapped over the front surface 354 of the backing piece 352. Preferably, the arms 374A and 374B include hook and loop fasteners on facing surfaces. A hook and loop fastener section on the lower band is secured to the arm 372B.

After a cellular telephone or the like is inserted into the adjustable pocket 350, the second arm 372A is wrapped over and secured to arm 372B. Arm 374A is wrapped over and secured to arm 374B. The upper band 360 is wrapped over arm 372A and the female fastener 364 is snapped onto the male fastener 370.

A clip or hook 380 is mounted to the rear surface 356 of the backing piece 352 by any desired means. Preferably, the clip 380 includes a flexible and resilient end 382.

As illustrated in FIG. 8, the adjustable pocket 350 is mounted in a first position 390 indicated by long dashed lines on the mounting piece 302. In the first position 390, the clip 380 passes through opening 342 and leg 346. Alternately, the adjustable pocket 350 is mounted in a second position 392 indicated by short dashed lines on the mounting piece 302. In the second position, the clip 380 passes through opening 340 and leg 348 The adjustable pocket 350 is mounted as desired by a wearer on the mounting piece 302.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. An apparatus for carrying a cellular telephone or the like comprising:

an adjustable shoulder harness including at least two openings formed therein; and an adjustable pocket for receiving a cellular telephone and having a clip, the clip being releasably received in one of the at least two openings to orient the pocket in a first position relative to the harness and the clip being releasably received in another one of the at least two openings to orient the pocket in a second position relative to the harness.

2. The apparatus claimed in claim 1 wherein the adjustable pocket is removably attached to the shoulder harness.

3. The apparatus claimed in claim 1 wherein the shoulder harness includes a harness strap to be fitted over a wearer's shoulder and a belt to be fitted about a wearer.

4. The apparatus claimed in claim 3 wherein the shoulder harness includes vents.

5. The apparatus claimed in claim 1 wherein the adjustable pocket includes:

a backing piece;

a upper band extending from the backing piece;

a lower band extending from the backing piece and aligned with the upper band; and a least one strap extending from the backing piece.

6. The apparatus claimed in claim 5 wherein the upper band is stretchable.

7. The apparatus claimed in claim 5 wherein the upper band includes a hook that is received by a tab on the lower band.

8. The apparatus claimed in claim 5 wherein the strap includes first and second arms extending from opposite sides of the backing piece.

9. The apparatus claimed in claim 8 wherein one arm includes a loop.

10. The apparatus claimed in claim 8 wherein the arms include complementary areas of hook and loop fasteners that cooperate to hold the arms together.

11. An adjustable carrying case for a cellular telephone comprising:

a backing piece;

an upper band extending from the backing piece;

a lower band extending from the backing piece and aligned with the upper band; and at least one strap extending from the backing piece, the strap including first and second arms extending from opposite sides of the backing piece.

12. The carrying case claimed in claim 11 wherein one arm of the first and second arms includes a loop.

13. The carrying case claimed in claim 11 wherein the arms include complementary areas of hook and loop fasteners that cooperate to hold the arms together.

14. The carrying case claimed in claim 11 wherein the upper band is stretchable.

15. The carrying case claimed in claim 11 wherein the upper band includes a hook that is received by a tab on the lower band.

16. An adjustable carrying case holding a cellular telephone comprising:

an adjustable shoulder harness having a harness strap attached to a mounting piece, a belt attached to the mounting piece, and first, second, and third openings provided on the mounting piece; and an adjustable pocket having a clip, wherein the clip is inserted into the first and third openings of the mounting piece for a first position of the adjustable pocket and wherein the clip is inserted into the second and third openings of the mounting piece for a second position of the adjustable pocket.

17. The carrying case specified in claim 16 wherein:

the first opening is generally rectangular;

the second opening is generally rectangular; and the third opening is generally L-shaped and oriented so that each leg of the L-shaped opening is approximately perpendicular to one of the first and second openings.

18. The carrying case specified in claim 16 wherein the harness strap includes a cut-out provided along an inner circumference to enhance fit and comfort.

19. The carrying case specified in claim 16 including:

first and second elastic connecting straps, wherein a first end of each strap is attached to the mounting piece and a second end of each strap is attached to the belt; and an elastic portion provided in the belt.

* * * * *